US005189891A

United States Patent [19]

Sakamoto

[11] Patent Number: 5,189,891

[45] Date of Patent: Mar. 2, 1993

[54] AUGER TYPE ICE MAKING MACHINE

[75] Inventor: Shigetoshi Sakamoto, Nagoya, Japan

[73] Assignee: Hoshizaki Denki Kabushiki Kaisha, Toyoake, Japan

[21] Appl. No.: 769,591

[22] Filed: Oct. 1, 1991

[30] Foreign Application Priority Data

Oct. 1, 1990 [JP] Japan ..... 2-264618

[51] Int. Cl.[5] ..... F25C 1/14

[52] U.S. Cl. ..... 62/354; 100/117

[58] Field of Search ..... 62/354; 100/117

[56] References Cited

U.S. PATENT DOCUMENTS

| | | | |
|---|---|---|---|
| 3,196,624 | 7/1965 | Reynolds | 62/354 X |
| 4,497,184 | 2/1985 | Utter et al. | 62/354 |
| 4,682,475 | 7/1987 | Nelson | 62/354 |
| 4,741,173 | 5/1988 | Neumann | 62/354 X |
| 4,969,337 | 11/1990 | Hida | 62/354 X |

*Primary Examiner*—William E. Tapolcai

*Attorney, Agent, or Firm*—Nikaido, Marmelstein, Murray & Oram

[57] ABSTRACT

In an auger type ice making machine having an upright evaporator housing the internal wall of which is formed with a cylindrical freezing surface, and an auger mounted for rotary movement within the evaporator housing to scrape ice crystals off the freezing surface and to advance the scraped ice crystals toward an upper end of the housing, an extruding head assembly mounted on the upper end of the evaporator housing includes a cylindrical head member coaxially coupled with the upper end of the evaporator housing, the head member having an internal cylindrical wall formed with a plurality of circumferentially equally spaced radial projections forming a plurality of circumferentially equally spaced compression chambers to which the scraped ice crystals are successively introduced under the action of the auger, and a thrust mechanism mounted on an upper end of the auger to compress radially outwardly the ice crystals introduced into the compression chambers in accordance with rotation of the auger.

4 Claims, 18 Drawing Sheets

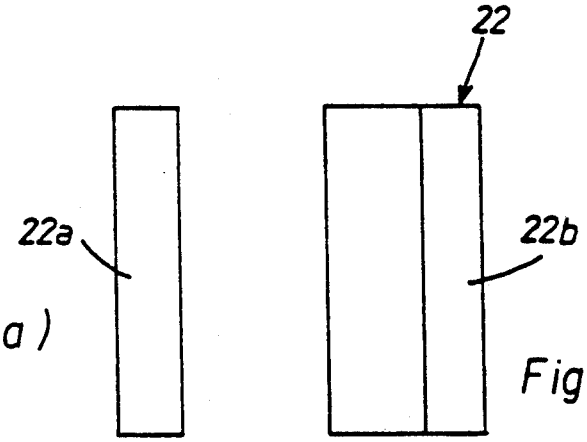
Fig. 9(a)
Fig. 9(b)
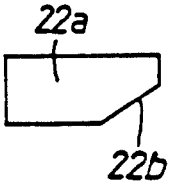
Fig. 9(c)
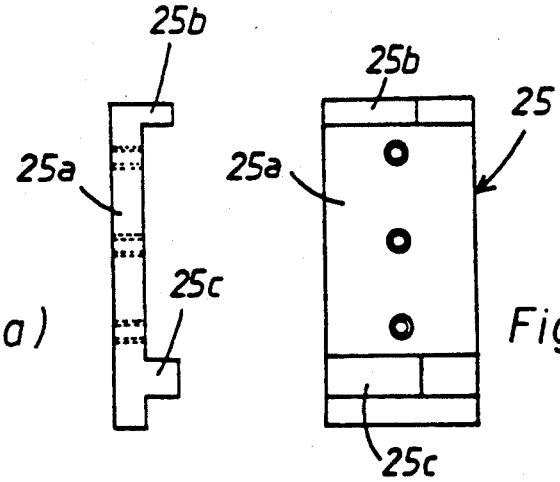
Fig. 10(a)
Fig. 10(b)
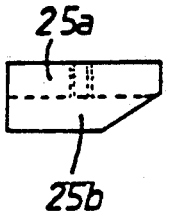
Fig. 10(c)

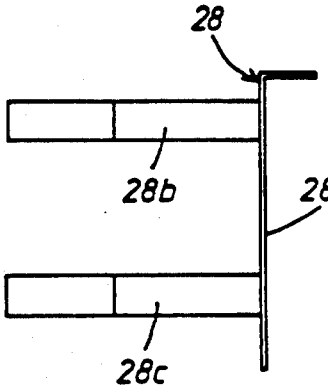
Fig. 19(a)
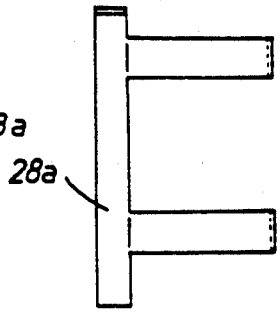
Fig. 19(b)
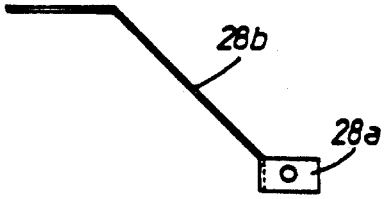
Fig. 19(c)
Fig. 20
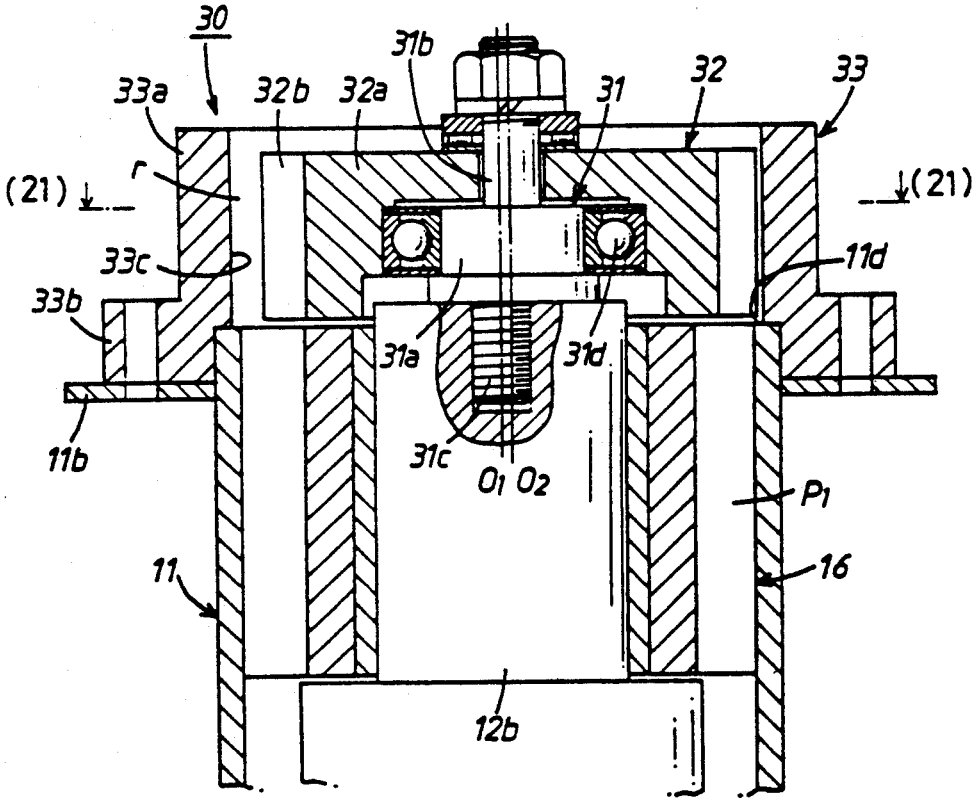

AUGER TYPE ICE MAKING MACHINE

BACKGROUND OF THE INVENTION

1. Field of the Invention

The present invention relates to auger type ice making machines, more particularly to an improvement of an extruding head assembly in the auger type ice making machines.

2. Description of the Prior Art

An auger type ice making machine of this kind incorporates an auger which is mounted for rotary movement within a cylindrical evaporator housing to which fresh water is supplied to cause ice crystals to form on the internal freezing surface of the evaporator housing. As the auger is driven by an electric motor drivingly connected to its lower end, the helical blade thereof scraps the ice crystals off the internal freezing surface of the evaporator housing and advances the scraped ice crystals upwardly toward an extruding head mounted on the upper end of the evaporator housing. The ice compressed at the extruding head is broken by a breaker blade and delivered as pieces of hard ice to an ice storage bin or a discharge duct mounted on the evaporator housing.

In general, the conventional extruding head is classified in first and second types as described below. In U.S. Pat. No. 4,741,173 issued on May 3, 1988, there is disclosed an extruding head of the first type which is formed with a plurality of straight ice extruding passages adapted to be positioned at the upper end of the evaporator housing for compressing the scraped ice crystals introduced therein under the action of the auger and for delivering the compressed ice bodies as relatively hard bodies of ice from its outlet. In U.S. Pat. No. 3,756,041 issued on Sep. 4, 1973, there is disclosed an extruding head of the second type which includes upper and lower head sections secured together and adapted to be positioned at the upper end of the evaporator housing. The lower head section is formed to define a cylindrical chamber therein for receiving the scraped ice crystals fed under the action of the auger and is provided with a plurality of radially extending extrusion passages in communication with the receiving chamber at their inner extremities. An extruding cam is disposed within the receiving chamber and mounted on the upper end portion of the auger for rotation therewith. The upper head section is formed with a plurality of radially extending depressions for deterring rotational movement of the scraped ice crystals within the receiving chamber. In operation, the scraped ice crystals from the evaporator housing are introduced into the receiving chamber under the action of the auger and forced radially outwardly by rotation of the extruding cam to be compressed at the extrusion passages.

In such extruding head assemblies as described above, the extrusion passages are tapered outwardly to compress the scraped ice crystals fed from the evaporation housing under the action of the auger. During compression of the ice crystals at the extrusion passages, the auger is applied with a great load caused by transfer resistances of the ice crystals at the extrusion passages. For this reason, the electric motor is designed, in general, to produce a large torque against the load acting on the auger. The electric motor, therefore, becomes large in size, resulting in consumption of the power.

SUMMARY OF THE INVENTION

It is, therefore, a primary object of the present invention to provide an improved extruding head assembly for the auger type ice making machine capable of decreasing the load acting on the auger.

According to the present invention, there is provided an auger type ice making machine having an upright evaporator housing the internal wall of which is formed with a cylindrical freezing surface and an auger mounted for rotary movement within the evaporator housing to scrape ice crystals off the freezing surface and to advance the scraped ice crystals toward an upper end of the housing, wherein an extruding head assembly mounted on the upper end of the evaporator housing comprises a cylindrical head member coaxially coupled with the upper end of the evaporator housing, the head member having an internal cylindrical wall formed with a plurality of circumferentially equally spaced radial projections forming a plurality of circumferentially equally spaced compression chambers to which the scraped ice crystals are successively introduced under the action of the auger, and a thrust mechanism mounted on an upper end of the auger to compress radially outwardly the ice crystals introduced into said compression chambers in accordance with rotation of the auger.

BRIEF DESCRIPTION OF THE DRAWINGS

Additional objects, features and advantages of the present invention will be more readily appreciated from the following detailed description of preferred embodiments thereof when taken together with the accompanying drawings, in which:

FIGS. 9(*a*) is a side view of a thrust element shown in FIG. 2;

FIG. 9(*b*) is a front view of the thrust element;

FIG. 9(*c*) is a plan view of the thrust element;

FIG. 10(*a*) is a side view of a thrust element shown in FIG. 14;

FIG. 10(*b*) is a front view of the thrust element shown in FIG. 10(*a*);

FIG. 10(*c*) is a plan view of the thrust element shown in FIG. 10(*a*);

FIG. 17(*b*) is a side view of the attachment plate;

FIG. 18(*b*) is a side view of the first leaf spring;

FIG. 18(*c*) is a plan view of the first leaf spring;

FIG. 19(*a*) is a front view of a second leaf spring shown in FIGS. 14 and 15;

FIG. 19(*b*) is a side view of the second leaf spring;

FIG. 19(*c*) is a plan view of the second leaf spring;

FIG. 20 is a vertical sectional view of an alternate embodiment of the present invention;

DESCRIPTION OF THE PREFERRED EMBODIMENTS

Figure 1:
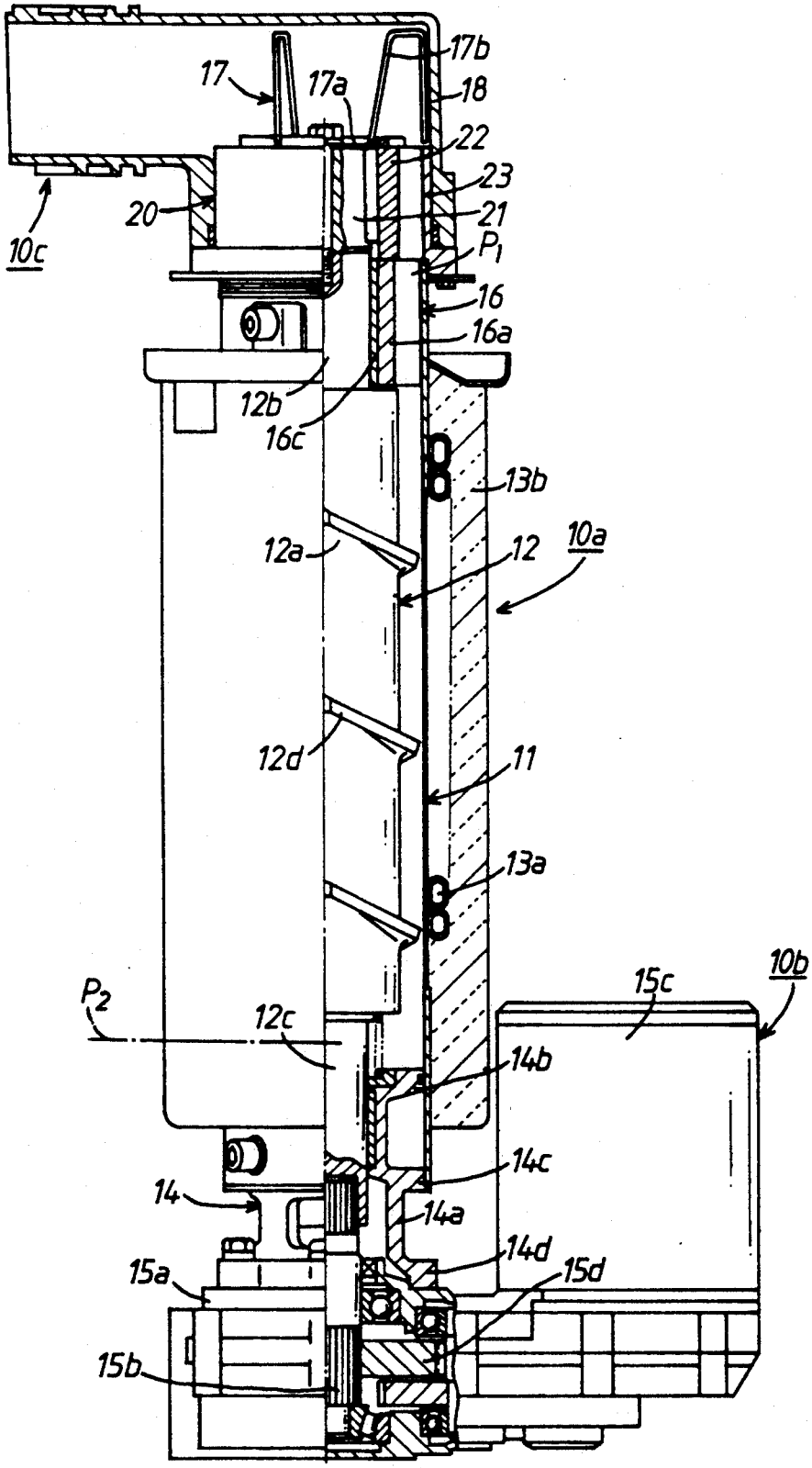
FIG. 1 is a partly broken sectional view of an auger type ice making machine.

Referring now to the drawings, FIG. 1 illustrates an auger type ice making machine which is composed of a freezing mechanism 10*a*, a drive mechanism 10*b*, a discharge mechanism 10*c* and an extruding head assembly 20. The freezing mechanism 10*a* includes an upright cylindrical evaporator housing 11 surrounded by a coil 13*a* through which refrigerant is passed in a usual manner to chill the housing 11 and an auger 12 mounted for rotary movement within the evaporator housing 11 to which fresh water is supplied at P2 to cause ice crystals to form on the internal freezing surface of the evaporator housing 11. The evaporator housing 11 is vertically mounted on a housing 15*a* of the drive mechanism 10*b* through a hollow support member 14. The evaporator coil 13*a* is provided as a part of a refrigeration circuit (not shown) and is surrounded by an insulation material 13*b*. The support member 14 has a pair of axially spaced annular flanges 14*b*, 14*c* coupled in a liquid-tight manner within the lower end portion of evaporator housing 11 and a lower annular flange 14*d* secured to the lower housing 15*a* of the drive mechanism 15 for supporting the evaporator housing 11 in place. The drive mechanism 10*b* includes an electric motor 15*c* which is drivingly connected to a drive shaft 15*b* by means of a speed reduction gear train 15*d*.

Figure 2:
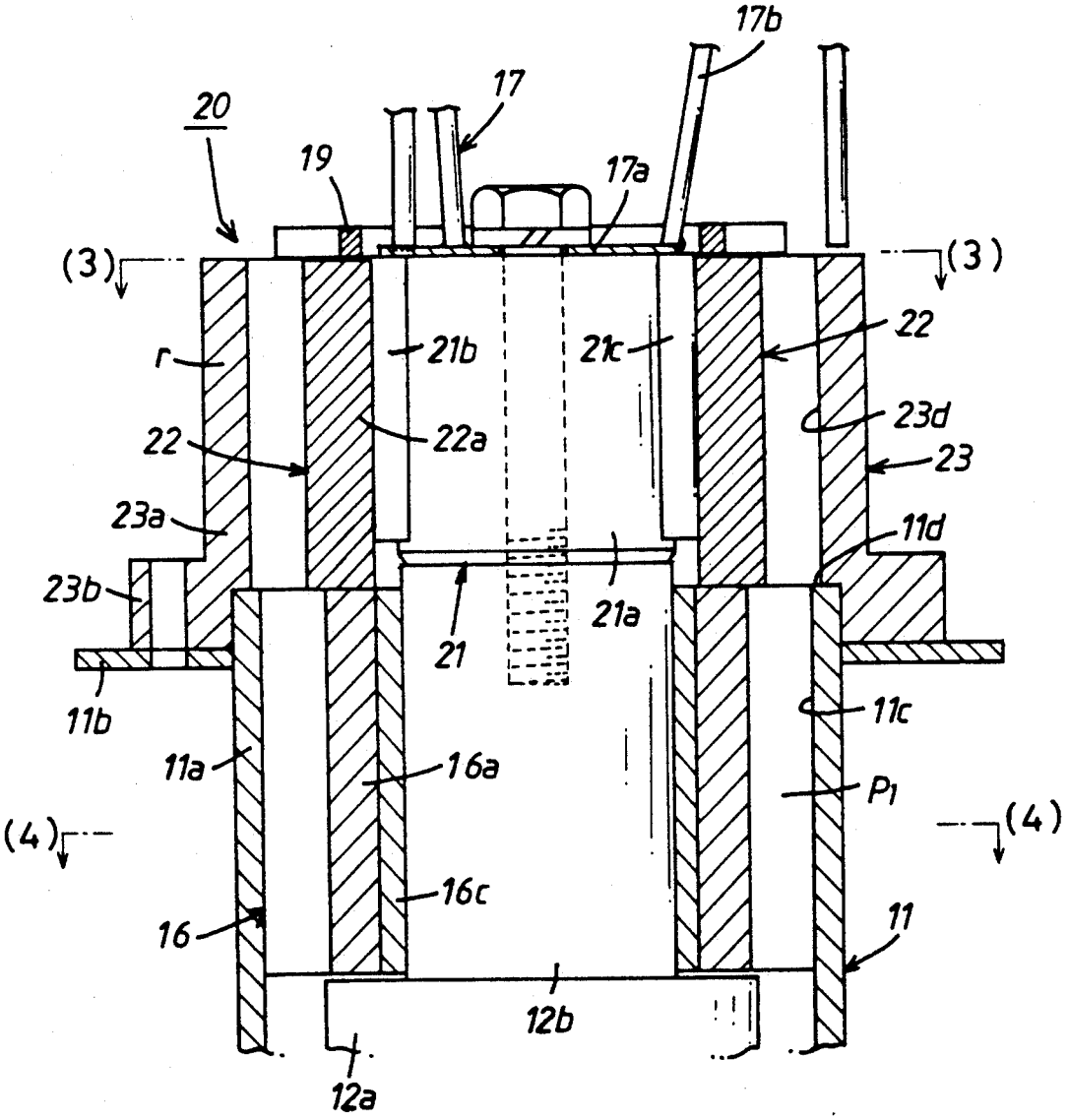
FIG. 2 is an enlarged vertical sectional view of an extruding head assembly shown in FIG. 1.
Figure 3:
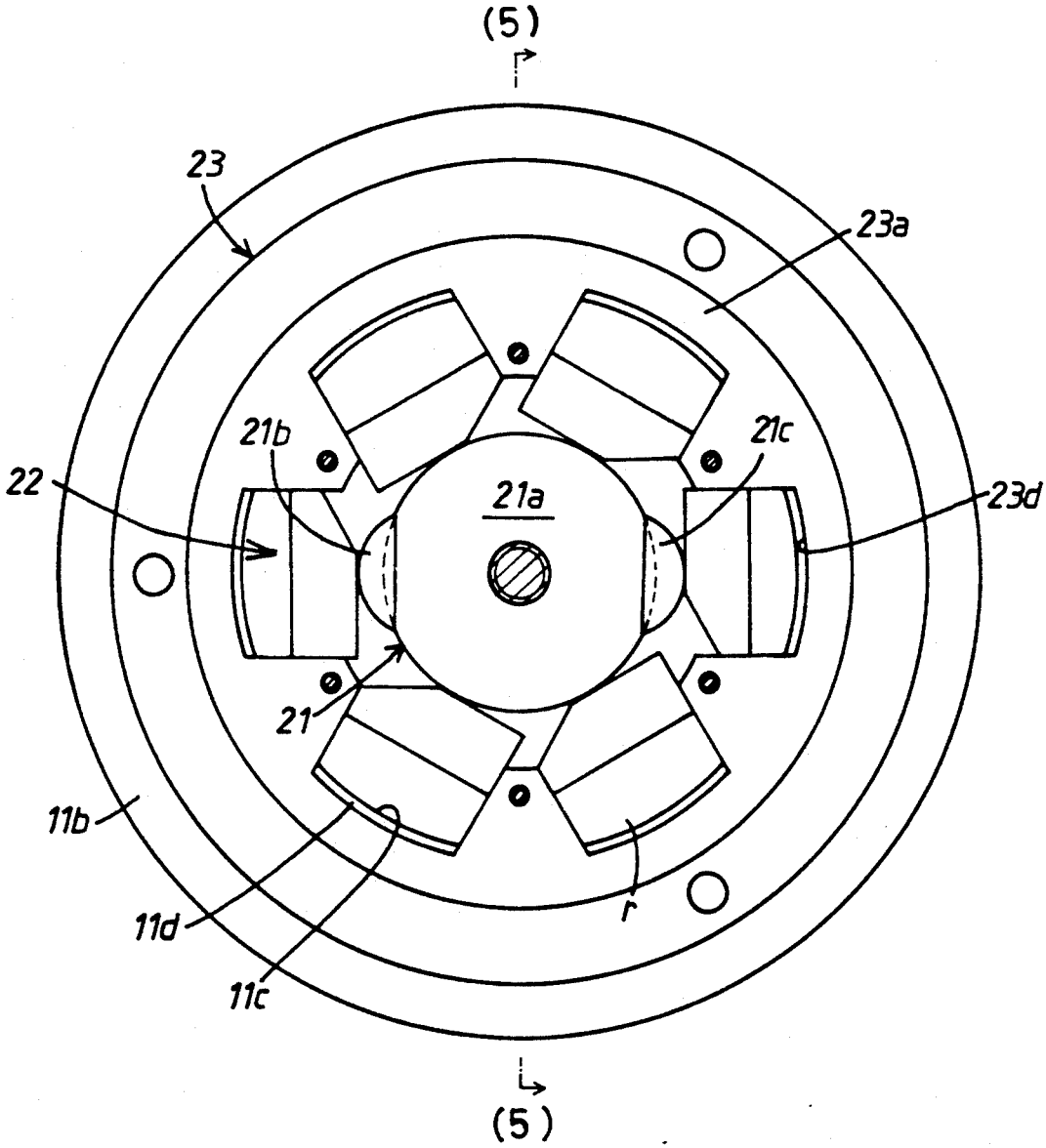
FIG. 3 is a plan view taken along line (3)—(3) in FIG. 2.
Figure 4:
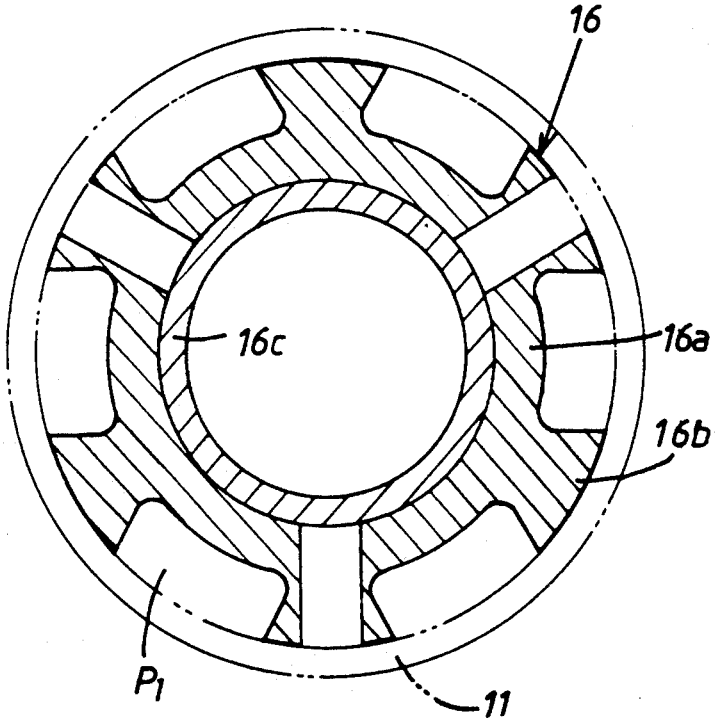
FIG. 4 is a cross-sectional view taken along line (4)—(4) in FIG. 2.
Figure 5:
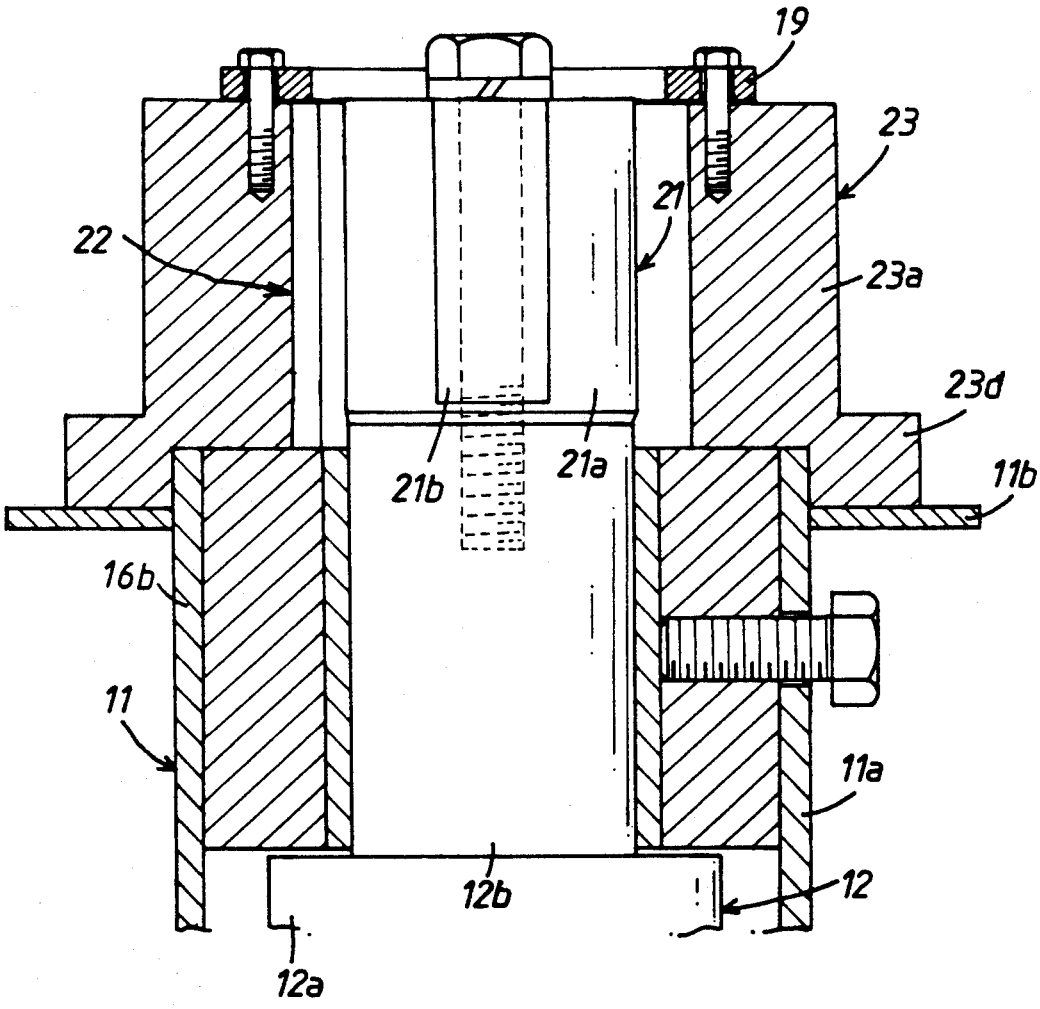
FIG. 5 is a vertical sectional view taken along line (5)—(5) in FIG. 3.

The auger 12 has a body portion 12*a* of large diameter integrally formed thereon with a helical blade 12*d* and upper and lower shaft portions 12*b* and 12*c*. The lower shaft portion 12*c* is rotatably carried by the support member 14 and is drivingly connected to the drive shaft 15*b* of the drive mechanism 10*b*. The upper shaft portion 12*b* is rotatably carried by an upper cylindrical support member 16 through a liner sleeve 16*c* of a suitable bearing material. The cylindrical support member 16 is assembled within the upper end portion of evaporator housing 11 and fixed in place by means of bolts threaded therein through the upper end portion of evaporator housing 11. As shown in FIGS. 2 and 4, the cylindrical support member 16 has a cylindrical body portion 16*a* coupled with the liner sleeve 16*c* and a plurality of circumferentially equally spaced radial projections 16*b* extending radially outwardly from the cylindrical body portion 16*a*. The radial projections 16*b* are coupled within the upper end portion of evaporator housing 11 to form a plurality of ice transfer passages P1. The radial projections 16*b* are tapered toward the body portion 16*a* and extend from bottom to top of the body portion 16*a*. In this embodiment, it is to noted that the ice transfer passages P1 are formed to smoothly introduce the scraped ice crystals fed from the auger 12 toward the extruding head assembly 20 and to slightly compress the scraped ice crystals therein.

Figure 6:
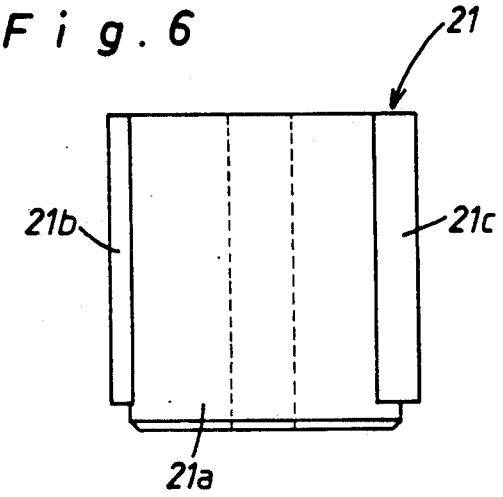
FIG. 6 is a front view of a central rotary member shown in FIG. 2.
Figure 7:
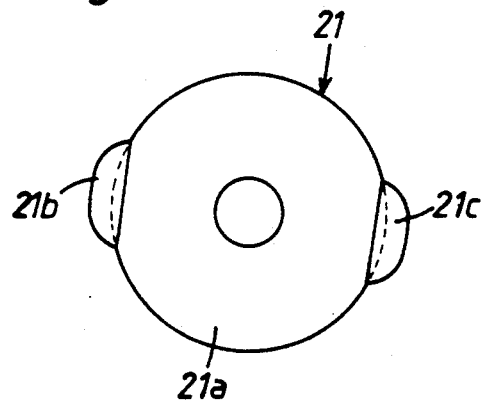
FIG. 7 is a plan view of the central rotary member shown in FIG. 6.
Figure 11:
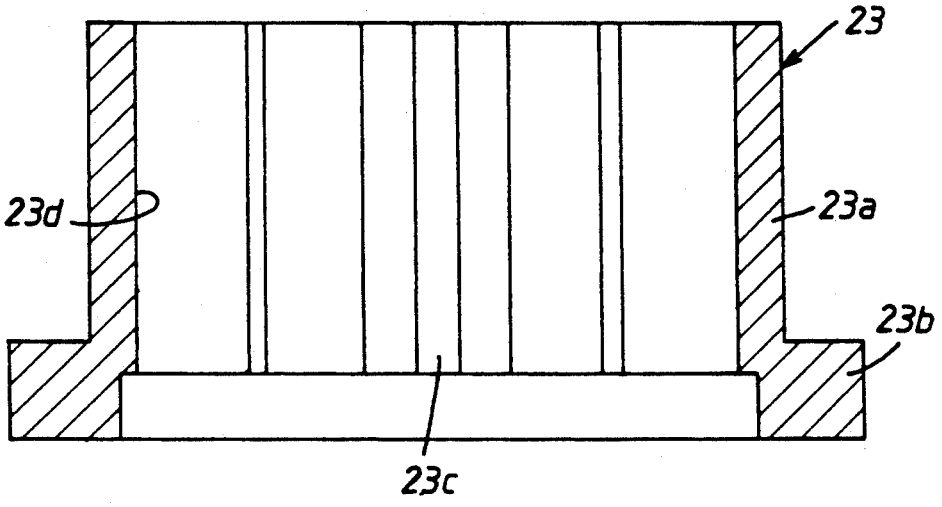
FIG. 11 is a vertical sectional view of a cylindrical head member shown in FIG. 2.
Figure 12:
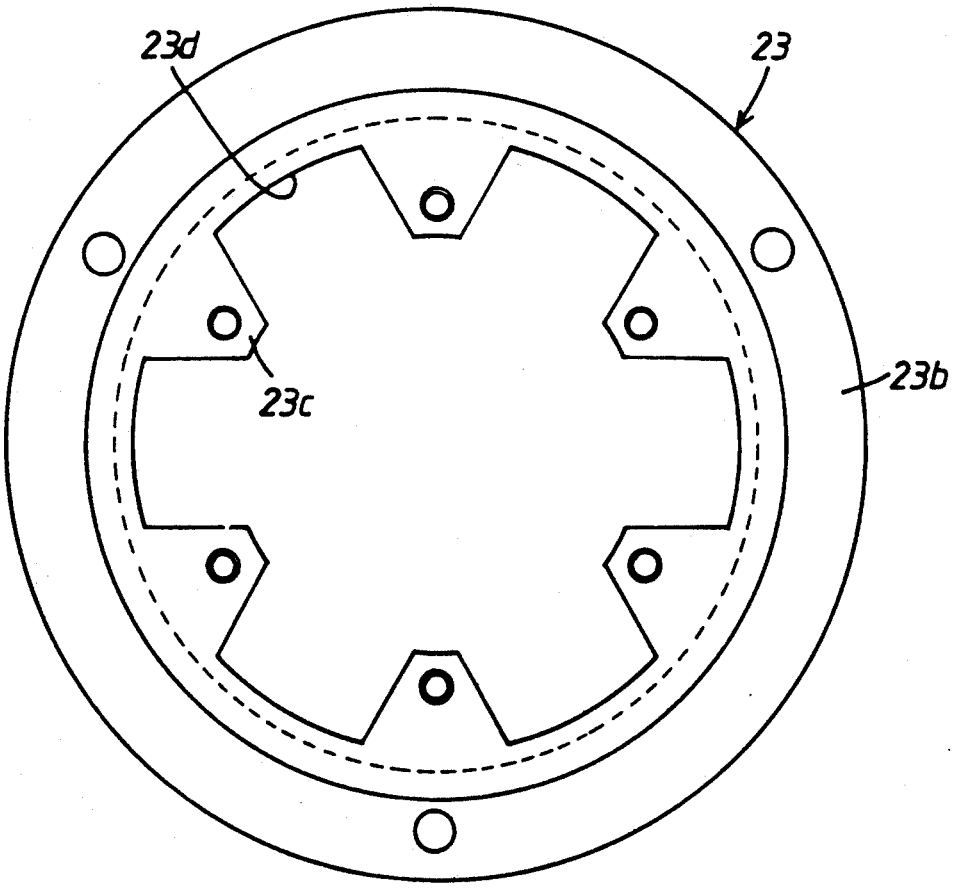
FIG. 12 is a plan view of the cylindrical head member.

As shown in FIGS. 1, 2, 3 and 5, the extruding head assembly 20 includes a central rotary member 21, a plurality of thrust elements 22 and a cylindrical head member 23. As shown in FIGS. 6 and 7, the central rotary member 21 has a columnar body portion 21*a* and a pair of diametrically opposed cam members 21*b*, 21*c* secured to the body portion 21*a* for rotation therewith. Each of the cam members 21*b*, 21*c* has a semicircular cross-section. As shown in FIG. 2, the columnar body portion 21*a* of rotary member 21 is coaxially mounted on the upper end of auger 12 and fixed in place by means of a fastening bolt threaded therethrough into the upper shaft portion of auger 12 for rotation therewith. As shown in FIGS. 9(*a*), 9(*b*) and 9(*c*), the thrust elements 22 each are in the form of a rectangular block 22*a* formed at one side with an inclined cam surface 22*b*. As shown in FIGS. 11 and 12, the cylindrical head member 23 has a cylindrical body portion 23*a* integrally formed at its inner periphery with a plurality of circumferentially equally spaced radial projections 23*c* and at its lower end with an annular flange 23*b*. The radial projections 23*c* extend radially inwardly toward the central axis of body portion 23*a* in a predetermined distance to form a plurality of circumferentially equally spaced radial recesses 23*d*.

Figure 13:
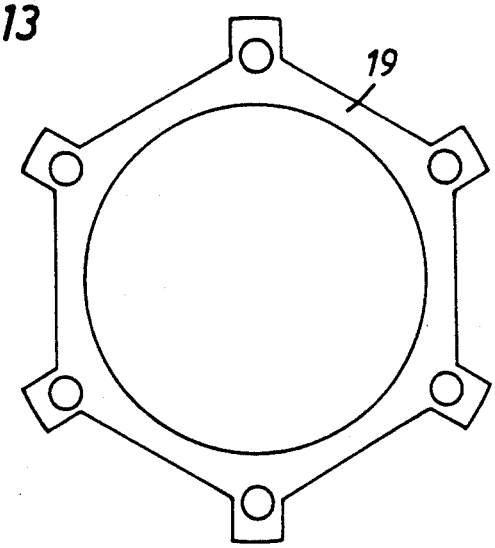
FIG. 13 is a plan view of a holding plate shown in FIG. 2.

As shown in FIG. 2, the cylindrical head member 23 is coaxially coupled with the upper end of evaporator housing 11 and received by an annular flange 11*b* secured to the upper end portion of evaporator housing 11. The head member 23 is fixed to the annular flange 11*b* of housing 11 at its annular flange 23*b* by means of bolts threaded therethrough. In a condition where the head member 23 has been assembled with the upper end of evaporator housing 11, each end wall of the radial recesses 23*d* is slightly displaced outwardly to form a stepped portion 11*d* at the upper end of housing 11, and the thrust elements 22 are slidably disposed within the radial recesses 23*d* to form a plurality of circumferentially equally spaced compression chambers r in communication with the respective ice transfer passages P1. The thrust elements 22 are received by the upper end of support member 16 to be moved radially outwardly by engagement with the cam projections 21*c* of central rotary member 21. In FIG. 13, there is illustrated a hexagonal holding plate 19 which is fixed to the upper end of cylindrical head member 23 to restrict upward movement of the thrust elements 22. (see FIG. 2)

As shown in FIG. 1, the discharge mechanism 10*c* includes a discharge duct 18 having a cylindrical portion coupled with the cylindrical body portion 23*a* of head member 23 and an agitator 17 mounted on the upper end of central rotary member 21 for rotation therewith. The cylindrical portion of discharge duct 18 is fixed to the annular flange 11*b* of evaporator housing 11 together with the annular flange 23*b* of head member 23 by means of the fastening bolts. The agitator 17 is composed of a hub plate 17*a* fixed to the central rotary member 21 by means of the fastening bolt and a plurality of agitator fingers 17*b* secured at their one ends to the hub plate 17*a*.

In operation of the ice making machine, ice crystals formed on the internal freezing surface of evaporator housing 11 are scraped by the helical blade 12*d* of auger 12 and introduced into the respective compression chambers r of head member 23 through the ice transfer passages P1. In the extruding head assembly 20, the central rotary member 21 rotates with the auger 12 to cause the cam members 21*b*, 21*c* to push the thrust elements 22 radially outwardly. Thus, the ice crystals introduced into the compression chambers r are successively compressed by the thrust elements 22 and extruded upwardly as relatively hard bodies of ice when released from the thrust elements 22. In this instance, the compressed ice bodies are successively broken by a shearing force applied thereto at the stepped portion 11*d*, and the thrust elements 22 are radially inwardly moved back by ice crystals subsequently introduced into the compression chambers r from the ice transfer passages P1 at each time when released from engagement with the cam members 21*b*, 21*c*. Thus, the compressed ice bodies are successively extruded upwardly from the compression chambers r and discharged by rotation of the agitator 17 from the discharge duct 18 to be stored in an appropriate storage bin (not shown).

As is understood from the above description, the scraped ice crystals fed from the auger 12 are successively introduced into the compression chambers r through the ice transfer passages P1 and compressed by the thrust elements 22 which are successively pushed radially outwardly by engagement with the cam members 21*b*, 21*c*. When the thrust elements 21*b*, 21*c* are successively released from the cam members 22, the compressed ice bodies are extruded upwardly by ice crystals subsequently introduced from the ice transfer passages P1 under the action of the auger 12. Such arrangement of the thrust elements 22 is effective to decrease the load acting on the auger 12 smaller than that in the conventional extruding head. Accordingly, the drive mechansim 10*b* can constructed small in size to decrease the consumption of the power.

Although in the extruding head assembly 20, the stepped portion 11*d* is provided at the upper end of the evaporator housing 11 to break the compressed ice bodies, the thrust elements 22 may be formed at their upper ends with radial projections for applying a shearing force to the compressed ice bodies extruded from the compression chambers r. In addition, the thrust elements 22 may be tapered downwardly at their lower ends to facilitate the introduction of scraped ice crystals into the compression chambers r.

Figure 8:
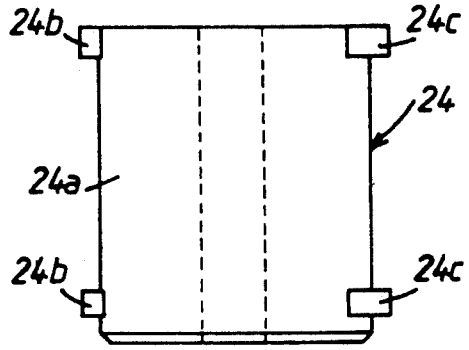
FIG. 8 is a front view of a modification of the central rotary member.
Figure 14:
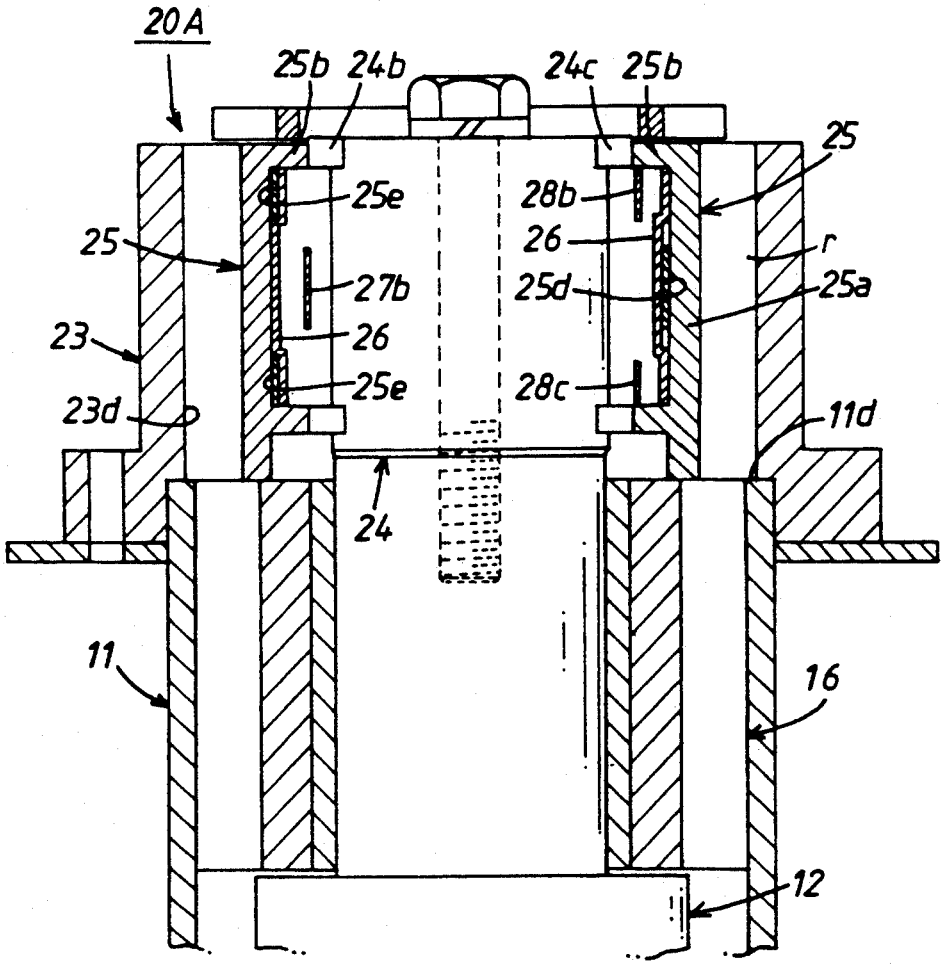
FIG. 14 is a vertical sectional view of a modification of the extruding head assembly shown in FIG. 2.
Figure 15:
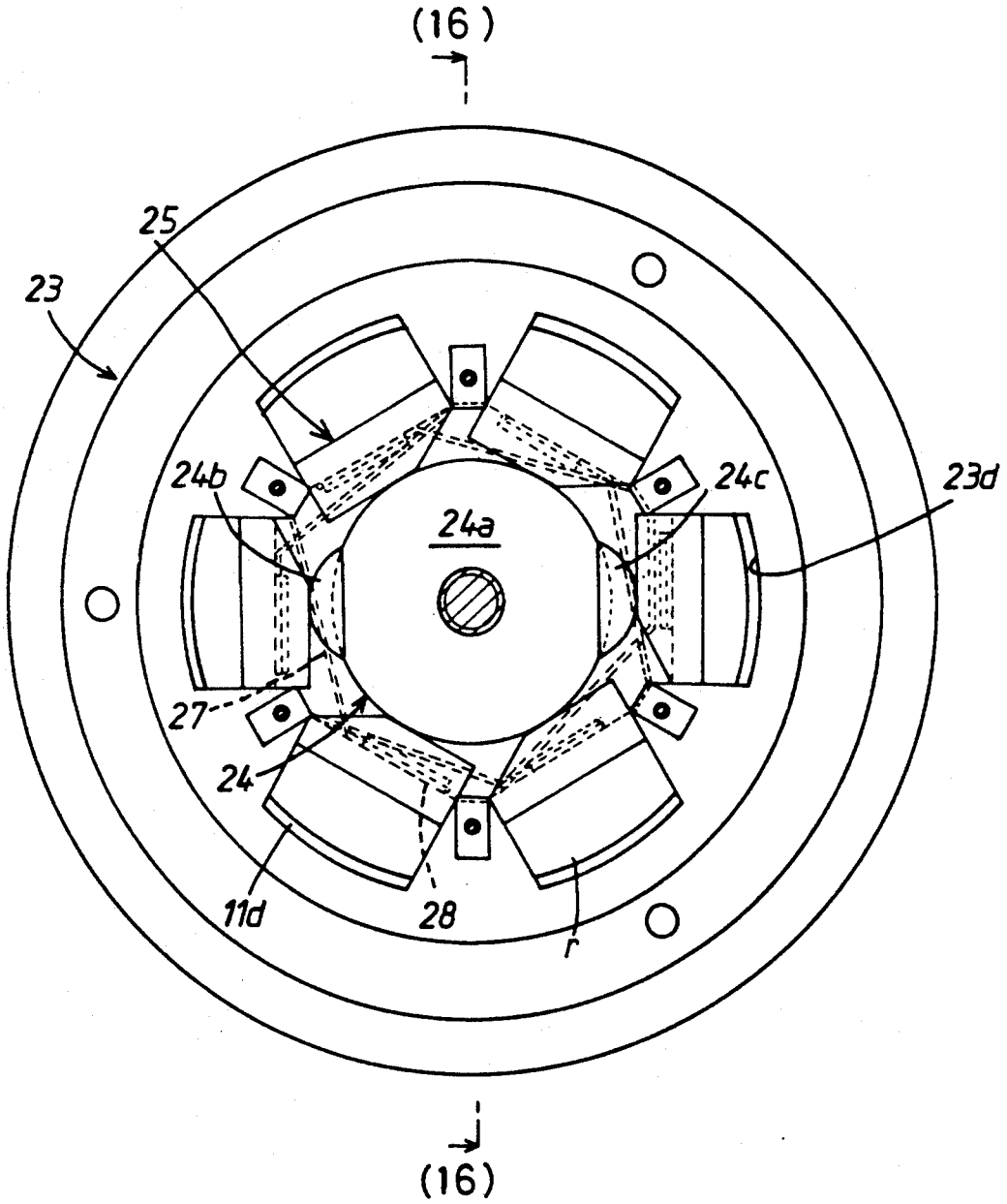
FIG. 15 is a plan view of the modification.
Figure 16:
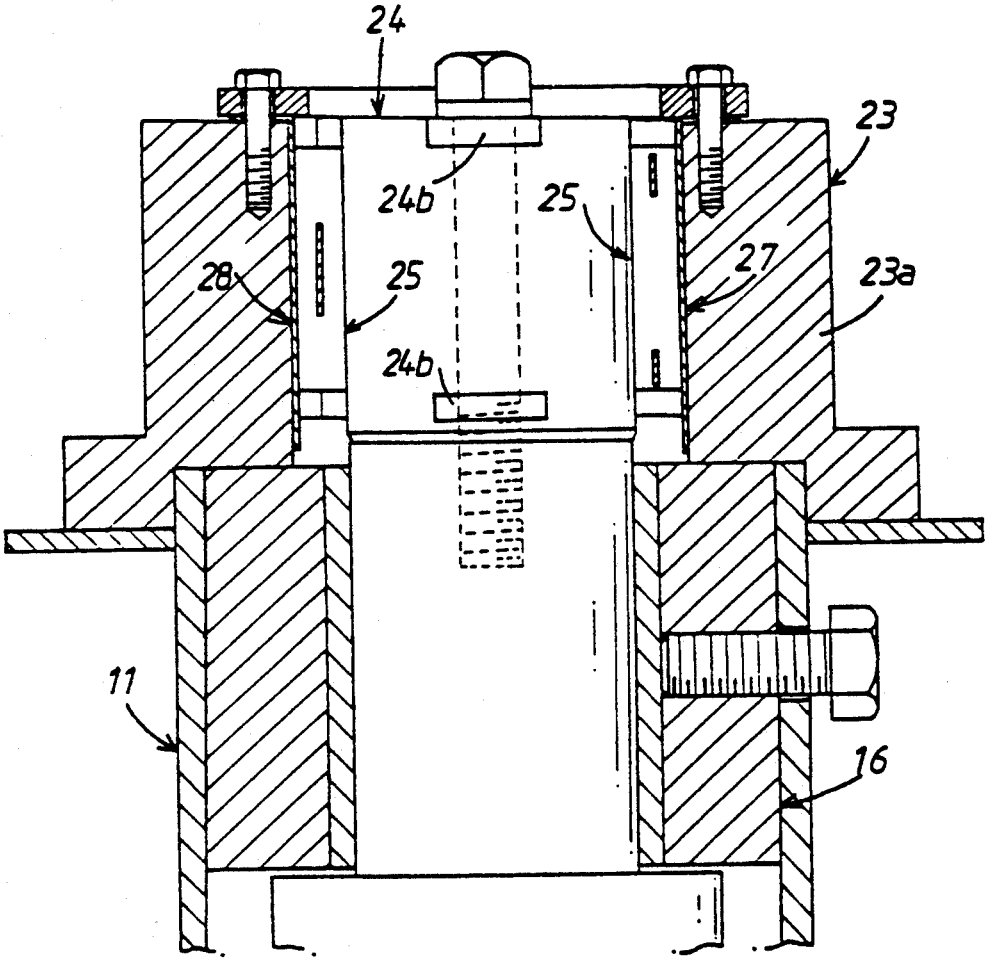
FIG. 16 is a vertical sectional view taken along line (16)—(16) in FIG. 15.
Figure 17A:
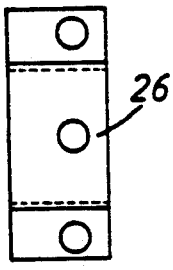
FIG. 17(*a*) is a front view of an attachment plate shown in FIG. 14.
Figure 17B:
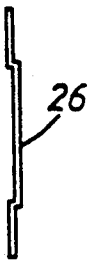

In FIGS. 14 to 16, a modification of the extruding head assembly 20 indicated by the reference character 20A includes a central rotary member 24 and a plurality of thrust elements 25 which correspond with the rotary member 21 and the thrust elements 22 of the extruding head assembly 20. As shown in FIG. 8, the central rotary member 24 has a columnar body portion 24*a* and two pairs of diametrically opposed cam members 24*b*, 24*c* respectively secured to the upper and lower portions of the columnar body portion 24*a*. Each of the cam members 24*b*, 24*c* has a semicircular cross-section. As shown in FIG. 14, the body portion 24*a* of rotary member 24 is coaxially mounted on the upper end of auger 12 and fixed in place by means of the fastening bolt threaded therethrough into the upper shaft portion of auger 12 for rotation therewith. As shown in FIGS. 10(*a*), 10(*b*) and 10(*c*), the thrust elements 25 each are in the form of a rectangular plate 25*a* having upper and lower projections 25*b* and 25*c* each formed at one side with an inclined cam surface. In FIGS. 17(*a*) and 17(*b*), there is illustrated an attachment plate 26 to be secured to the rear surface of the respective thrust plates 25 as shown in FIG. 14. A first set of the attachment plates 26 are engaged at their front surfaces with the corresponding thrust plates 25 and secured thereto by means of fastening screws (not shown) to form a vertical slit 25*d*, while a second set of the attachment plates 26 are engaged at their rear surfaces with the corresponding thrust plates 25 and secured thereto by means of fastening screws (not shown) to form a pair of vertical slits 25*e*. As shown in FIG. 15, the thrust plates 25 are slidably disposed within the radial recesses 23*d* of cylindrical head member 23 in the same manner as in the extruding head assembly 20 shown in FIGS. 2 and 3.

Figure 18A:
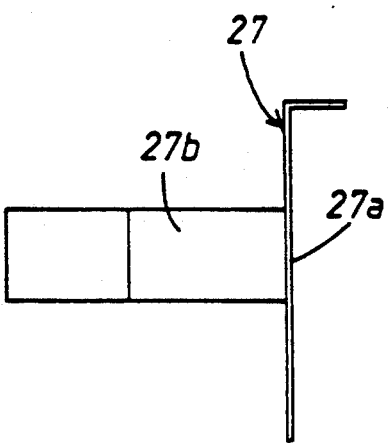
FIG. 18(*a*) is a front view of a first leaf spring shown in FIGS. 14 and 15.
Figure 18B:
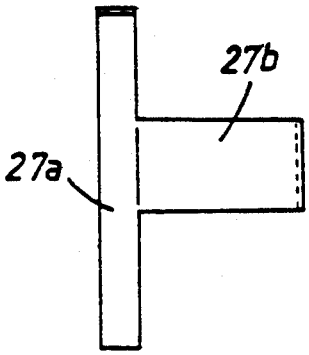
Figure 18C:
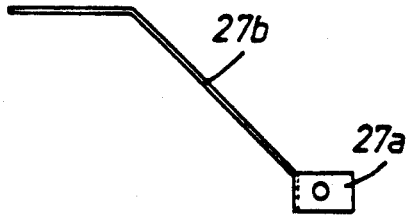

In FIGS. 18 and 19, there are illustrated two kinds of leaf springs 27 and 28 to be assembled with the cylindrical head member 23 as described below. The leaf spring 27 has a support portion 27*a* of L-letter shape in cross-section and a lateral spring portion 27*b* extending perpendicularly from the support portion 27*a*. The leaf spring 28 has a support portion 28*a* of L-letter shape in cross-section and a pair of lateral spring portions 28*b*, 28*c* extending perpendicularly from the support portion 28*a*. As shown in FIGS. 15 and 16, the leaf springs 27, 28 are alternately fixed at their upper ends to the circumferentially equally spaced projections 23*c* of extruding head member 23 by means of the fastening bolts in such a manner that the lateral portion 27*b* of leaf spring 27 is inserted into the vertical slit 25*d* and that the lateral portions 28*b*, 28*c* of leaf spring 28 are inserted into the pair of vertical slits 25*e*. Thus, the thrust plates 25 are supported by the leaf springs 27 and 28 and maintained in engagement with the central rotary member 24 under the resilient forces of leaf springs 27 and 28.

In operation of the ice making machine, rotation of the central rotary member 24 causes the cam members 24*b*, 24*c* to push the thrust plates 25 radially outwardly against the resilient forces of leaf springs 27, 28. Thus, the ice crystals introduced into the compression chambers r are successively compressed by the thrust plates 25 and extruded upwardly as pieces of hard ice when released from the thrust plates 25. In this instance, the compressed ice bodies are successively broken by a shearing force applied thereto at the stepped portion 11*d*, and the thrust plates 25 are radially inwardly moved back by the resilient forces of leaf springs 27,28 at each time when released from engagement with the cam members 24*b*, 24*c*. Thus, the scraped ice crystals are smoothly introduced into the compression chambers r from the ice transfer passages P1 to successively extrude the compressed ice bodies toward the interior of discharge duct 18.

Figure 21:
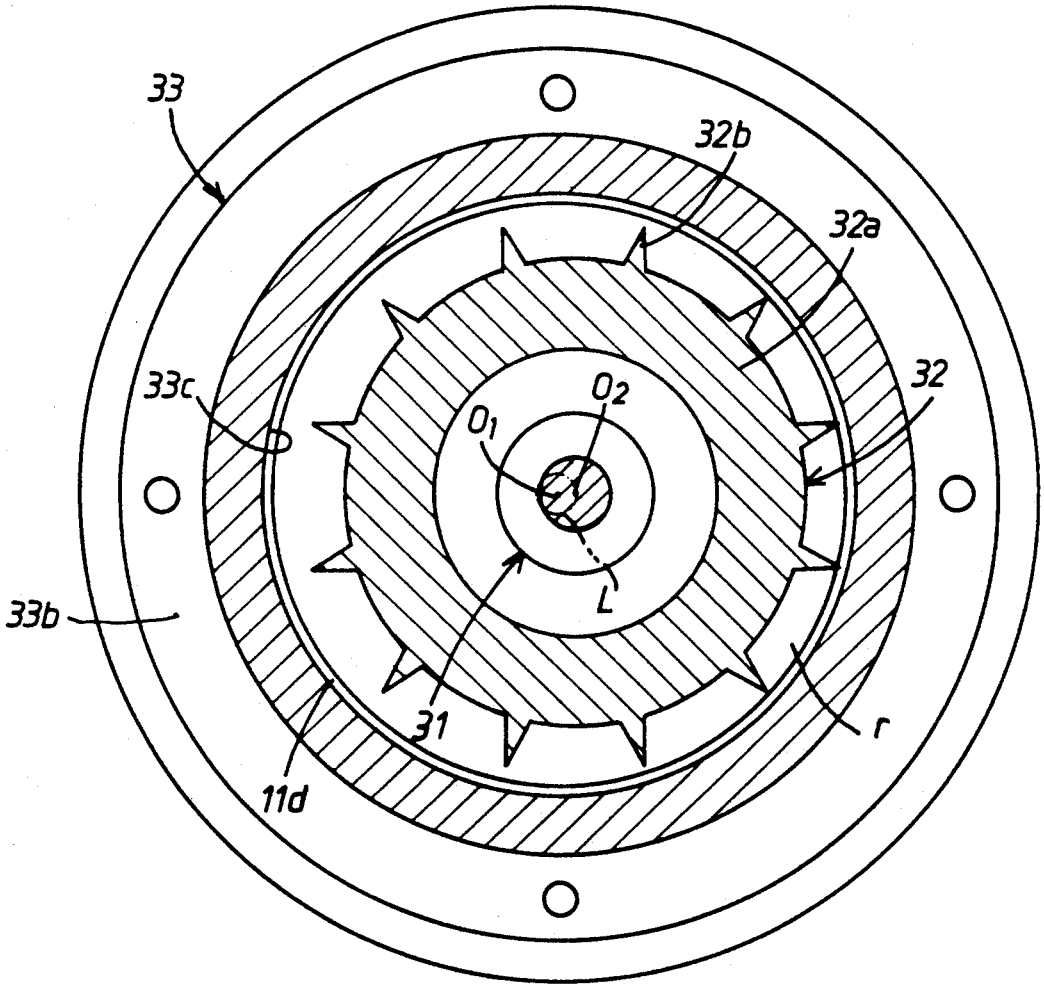
FIG. 21 is a cross-sectional view taken along line (21)—(21) in FIG. 20.

In FIGS. 20 and 21, there is illustrated an alternate embodiment of the present invention, wherein an extruding head assembly 30 includes a rotary member 31, a cylindrical thrust member 32 and a cylindrical head member 33. The rotary member 31 has a stepped rotary body portion 31*a* integrally provided with upper and lower stud bolts 31*b* and 31*c*. The central axis $O_2$ of upper stud bolt 31*b* coincides with the center of rotary body portion 31*a* and is radially displaced from the central axis $O_1$ of lower stud bolt 31*c* in a predetermined distance. The lower stud bolt 31*c* is coaxially threaded into the upper shaft portion 12*b* of auger 12 so that the rotary body portion 31*a* is eccentrically positioned with respect to the central axis of auger 12. The cylindrical thrust member 32 is rotatably coupled with the body portion 31*a* of rotary member 31 through a ball bearing 31*d*. The cylindrical thrust member 32 has a cylindrical body portion 32*a* integrally formed at its outer periphery with a plurality of circumferentially equally spaced radial projections 32*b* which extend from top to bottom of the body portion 32*a*.

The cylindrical head member 33 has a cylindrical body portion 33*a* integrally formed at its lower end with an annular flange 33*b*. The cylindrical head member 33 is coaxially coupled with the upper end of evaporator housing 11 and fixed to the annular flange 11*b* of evaporator housing 11 at its annular flange 33*b* by means of bolts threaded therethrough. In a condition where the cylindrical head member 33 has been assembled with the upper end of evaporator housing 11, the cylindrical thrust member 32 is eccentrically positioned with respect to the cylindrical head member 33 so that the radial projections 32*b* of thrust member 32 are associated with the cylindrical internal surface 33*c* of head member 33 to form a plurality of compression chambers r. In this embodiment, the inner diameter of head member 33 is determined slightly smaller than that of evaporator housing 11 to provide the stepped portion 11*d* at the upper end of housing 11.

In operation of the ice making machine, the scraped ice crystals are successively introduced into the compression chambers r from the ice transfer passages P1 under the action of the auger 12. In this instance, the central axis $O_2$ of rotary member 31 rotates about the central axis $O_1$ of auger shaft 12*b* as shown by the character L in FIG. 21. This causes the rotary member 31 to rotate eccentrically with respect to the auger shaft 12*b*. Thus, the cylindrical thrust member 32 is pushed by the eccentric rotation of rotary member 31 toward the cylindrical internal surface 33*c* of head member 33 to successively compress the scraped ice crystals introduced into the compression chambers r. The compressed ice bodies are broken by a shearing force applied thereto at the stepped portion 11*d* and extruded upwardly by scraped ice crystals subsequently introduced into the compression chambers r when released from the cylindrical thrust member 32.

Figure 22:
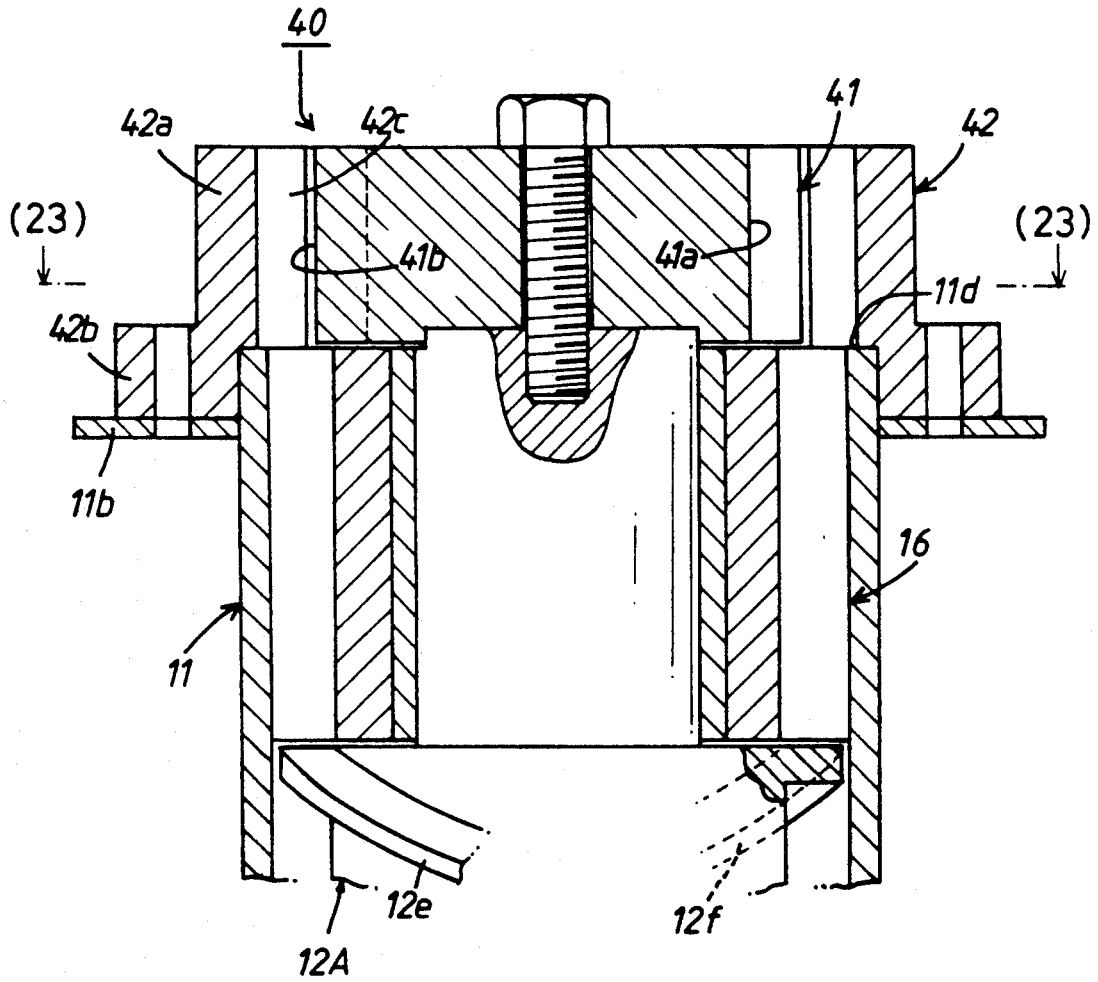
FIG. 22 is a vertical sectional view of another embodiment of the present invention.
Figure 23:
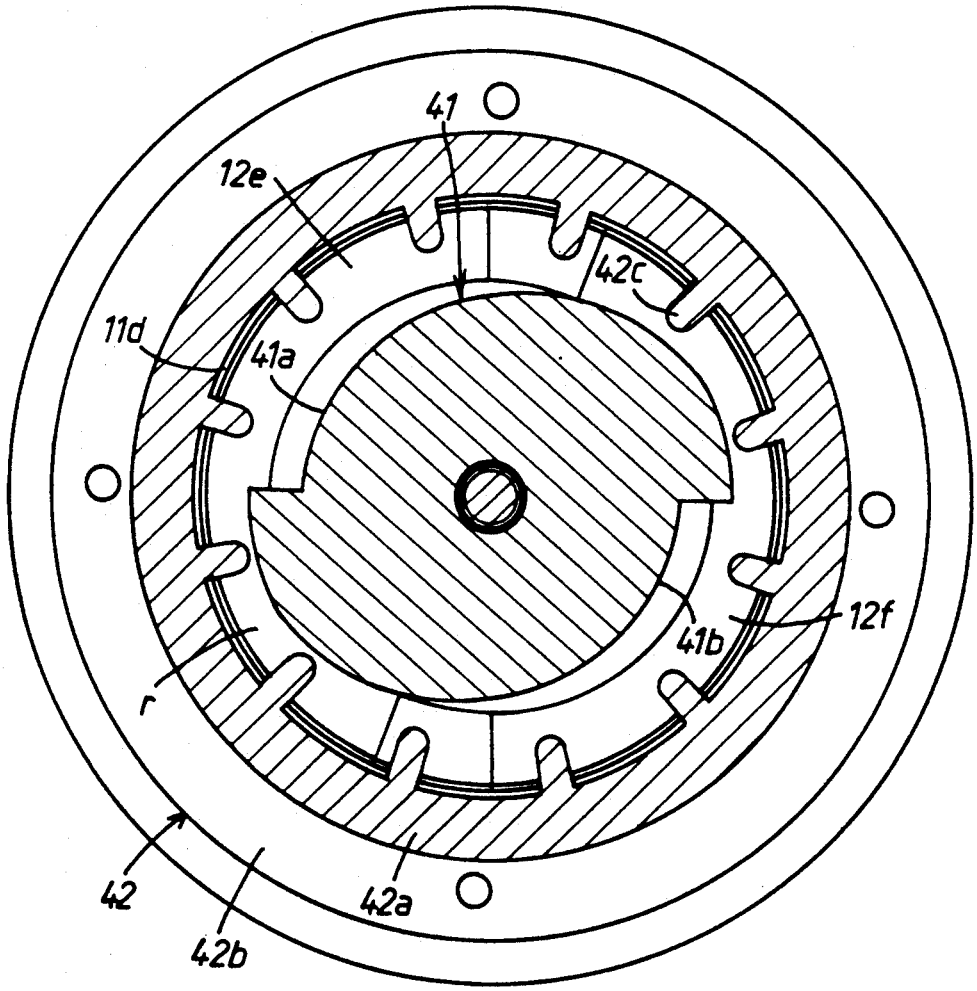
FIG. 23 is a cross-sectional view taken along line (23)—(23) in FIG. 22.

In FIGS., 22 and 23, there is illustrated another embodiment of the present invention, wherein an extruding head assembly 40 includes a rotary thrust member 41 and a cylindrical head member 42. The rotary thrust member 41 is in the form of a rotary cam member formed with a pair of diametrically opposed cam surfaces 41*a*, 41*b*. The rotary cam member 41 is coaxially mounted on the upper end of an auger 12A for rotation therewith. In this embodiment, the auger 12A is integrally formed thereon with two helical blades 12*e* and 12*f* as shown in FIG. 22. The cylindrical head member 42 has a cylindrical body portion 42*a* formed at its lower end with an annular flange 42*b* and at its inner periphery with a plurality of circumferentially equally spaced radial projections 42*c*. The cylindrical head member 42 is coaxially coupled with the upper end of evaporator housing 11 and fixed to the annular flange 11*b* of evaporator housing 11 at its annular flange 42*b* by means of bolts threaded therethrough. In a condition where the cylindrical head member 42 has been assembled with the upper end of evaporator housing 11, the radial projections 42*c* of head member 42 extend radially inwardly toward the cam surfaces 41*a*, 41*b* of rotary cam member 41 to form a plurality of circumferentially equally spaced compression chambers r. The inner diameter of cylindrical body portion 42*a* of head member 42 is determined slightly smaller than that of evaporator housing 11 to provide the stepped portion 11*d* at the upper end of housing 11.

In operation of the ice making machine, the scraped ice crystals are successively introduced into the compression chambers r from the ice transfer passages P1 under the action of the auger 12A. In this instance, the rotary cam member 41 rotates with the auger 12A to successively compress the scraped ice crystals at its cam surfaces 41*a* and 41*b*. The compressed ice bodies are broked by a shearing force applied thereto at the stepped portion 11*d* and extruded upwardly by scraped ice crystals subsequently introduced into the compression chambers r when released from the cam surfaces 41*a*, 41*b* of rotary cam member 41.

Figure 24:
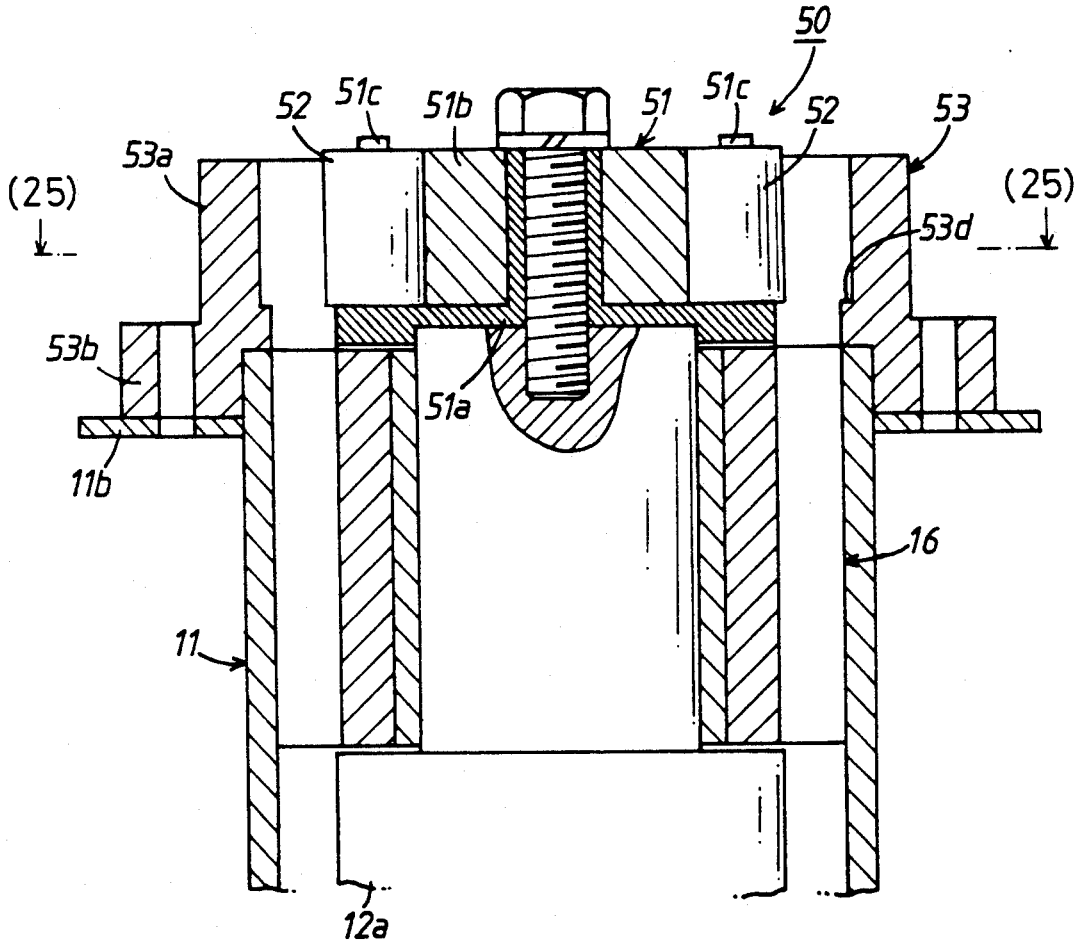
FIG. 24 is a vertical sectional view of another alternate embodiment of the present invention.
Figure 25:
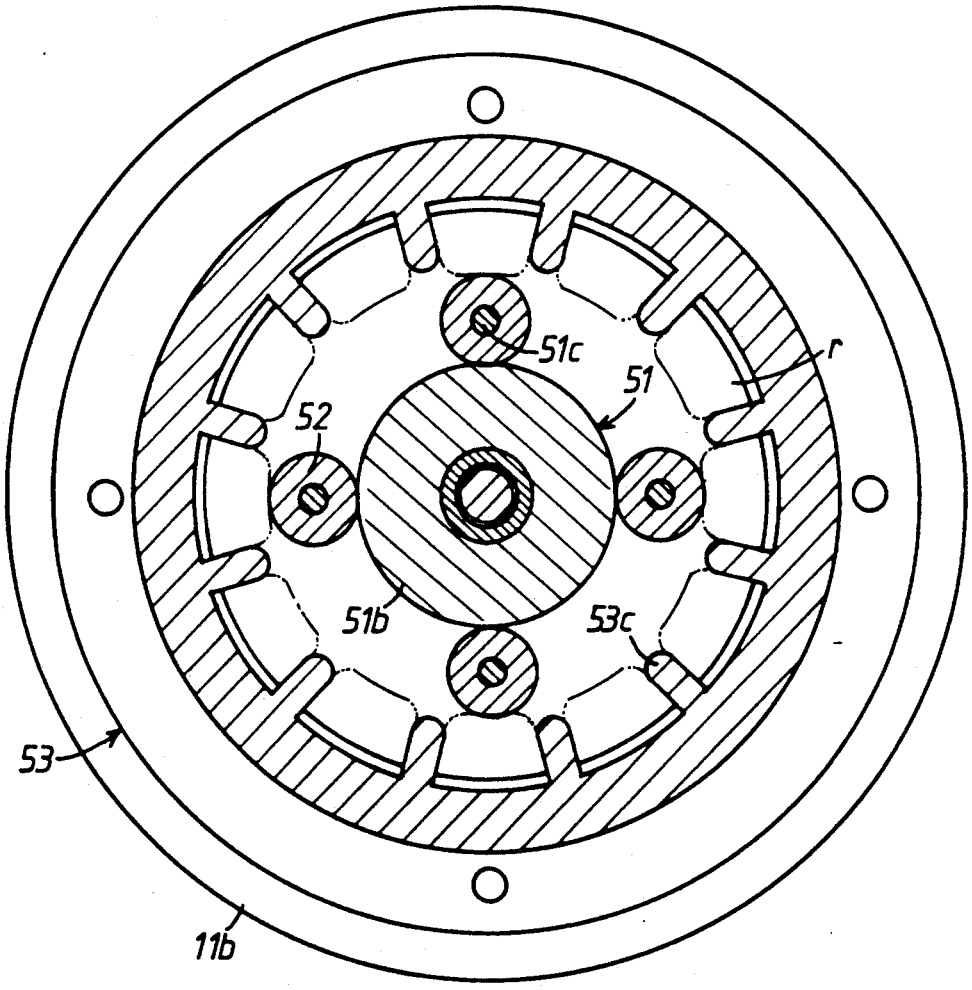
FIG. 25 is a cross-sectional view taken along line (25)—(25) in FIG. 24.

In FIGS. 24 and 25, there is illustrated an alternate embodiment of the present invention, wherein an extruding head assembly 50 includes a central rotary member 51, a plurality of thrust rollers 52 and a cylindrical head member 53. The central rotary member 51 has a columnar body portion 51*b* coupled with a sleeve portion of a retainer disk 51*a*. The retainer disk 51*a* is coaxially mounted on the upper end of auger 12 for rotation therewith and fixed in place by means of a bolt threaded therethrough into the upper end portion of auger 12. The thrust rollers 52 are rotatably carried by a plurality of circumferentially equally spaced support pins 51*c* secured to the retainer disk 51*a*. The thrust rollers 52 are maintained in engagement with the columnar body portion 51*b* of rotary member 51. The cylindrical head member 53 has a cylindrical body portion 53*a* formed at its lower end with an annular flange 53*b* and at its inner periphery with a plurality of circumferentially equally spaced radial projections 53*c*.

The cylindrical body portion 53*a* of head member 53 is further formed at its inner periphery with a stepped portion 53*d* which are located between the radial projections 53*c*. The cylindrical head member 53 is coaxially coupled with the upper end of evaporator housing 11 and fixed to the annular flange 11*b* of evaporator housing 11 at its annular flange 53*b* by means of bolts threaded therethrough. In a condition where the cylindrical head member 53 has been assembled with the upper end of evaporator housing 11, the radial projections 53*c* of head member 53 extend radially inwardly to form a plurality of circumferentially equally spaced compression chambers r.

In operation of the ice making machine, the scraped ice crystals are successively introduced into the compression chambers r from the ice transfer passages P1 under the action of the auger 12. In this instance, the retainer disk 51*a* rotates with the auger 12, and in turn, the thrust rollers 52 rotates with the retainer disk 51*a* to successively compress the scraped ice crystals introduced into the compression chambers r. The compressed ice bodies are broken by a shearing force applied thereto at the stepped portion 53*d* and extruded upwardly by scraped ice crystals introduced into the compression chambers r when released from the thrust rollers 52.

What is claimed is:

1. An auger type ice making machine having an upright evaporator housing, the internal wall of which is formed with a cylindrical freezing surface, and an auger mounted for rotary movement within said evaporator housing to scrape ice crystals off said freezing surface and to advance the scraped ice crystals toward an upper end of said housing, wherein an extruding head assembly mounted on the upper end of said evaporator housing comprises a cylindrical head member coaxially coupled with the upper end of said evaporator housing, said head member having an internal cylindrical wall formed with a plurality of circumferentially equally spaced radial projections forming a plurality of circumferentially equally spaced compression chambers to which the scraped ice crystals are successively introduced under the action of said auger, and a thrust mechanism mounted on an upper end of said auger to compress radially outwardly the ice crystals introduced into said compression chambers in accordance with rotation of said auger, said thrust mechanism comprising a plurality of thrust elements radially slidably disposed within said compression chambers to compress said ice crystals.

2. An auger type ice making machine as claimed in claim 1, wherein said thrust mechanism further comprises a central rotary member having a columnar body portion coaxially mounted on the upper end of said auger for rotation therewith, and a cam member secured to the body portion of said rotary member to move said thrust elements radially outwardly by engagement therewith during rotation of said auger.

3. An auger type ice making machine as claimed in claim 2, wherein resilient means is assembled with said cylindrical head member to bias thrust elements radially inwardly when released from engagement with said cam member.

4. An auger type ice making machine as claimed in claim 1, further comprising a cylindrical support member fixedly assembled within the upper end portion of said evaporator housing, said support member having a cylindrical body portion rotatably coupled with the upper end portion of said auger and a plurality of circumferentially equally spaced radial projections extending radially outwardly from the cylindrical body portion and coupled with the upper end portion of said evaporator housing to form a plurality of ice transfer passages in open communication with said compression chambers, wherein said thrust elements are radially slidably supported on said support member.

* * * * *